US006921280B2

(12) United States Patent
Becker et al.

(10) Patent No.: US 6,921,280 B2
(45) Date of Patent: Jul. 26, 2005

(54) CONNECTOR

(75) Inventors: Dirk Becker, Alheim (DE); Jürgen Zöll, Heringen-Herta (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 10/466,637

(22) PCT Filed: Jan. 18, 2002

(86) PCT No.: PCT/DE02/00158

§ 371 (c)(1),
(2), (4) Date: Nov. 5, 2003

(87) PCT Pub. No.: WO02/057618

PCT Pub. Date: Jul. 25, 2002

(65) Prior Publication Data

US 2004/0070204 A1 Apr. 15, 2004

(30) Foreign Application Priority Data

Jan. 19, 2001 (DE) ..... 101 17 969

(51) Int. Cl.[7] ..... H01R 13/627
(52) U.S. Cl. ..... 439/352
(58) Field of Search ..... 439/352, 350, 439/357, 34; 123/509, 516, 574, 557, 520, 456, 514, 506; 137/202, 43, 90.9, 143; 417/423.1, 366, 128

(56) References Cited

U.S. PATENT DOCUMENTS

| | | | |
|---|---|---|---|
| 1,989,986 | A | 2/1935 | Hudelson |
| 5,749,347 | A | 5/1998 | Torii et al. |
| 6,082,333 | A | 7/2000 | Vattelana et al. |

FOREIGN PATENT DOCUMENTS

| | | | |
|---|---|---|---|
| DE | 33 17 630 | A1 | 12/1983 |
| DE | 696 04 728 | T2 | 3/2000 |
| DE | 199 00 378 | A1 | 7/2000 |
| DE | 199 14 859 | A1 | 10/2000 |
| DE | 101 14 227 | A1 | 10/2001 |
| JP | 10-103179 | A1 | 4/1998 |
| JP | 10-184480 | A | 7/1998 |

*Primary Examiner*—Alexander Gilman
(74) *Attorney, Agent, or Firm*—Morrison & Foerster LLP

(57) ABSTRACT

The invention relates to a connector (3) for connecting a flow pipe leading to an internal combustion engine of a motor vehicle to a feed pump. Said connector comprises an elbowed connecting sleeve (7) which can be rotationally fixed in various angular positions in a receiver (6). Said connecting sleeve (7) is positively fixed in the receiver (6) by a catch means (9). In this way, the forces acting on the flow pipe are kept at a distance from a seal pertaining to the connecting sleeve (7).

9 Claims, 1 Drawing Sheet

CONNECTOR

The invention relates to a connection for a supply line, leading to an internal combustion engine of a motor vehicle, on a feed pump which feeds fuel from a fuel reservoir, having a receptacle which is connected to the feed pump and having a connector which can be connected in a positively locking fashion to the receptacle and has a bend.

Such connections are generally used for connecting the feed pump arranged inside a fuel reservoir to a part of the supply line running inside the fuel reservoir, and are known from practice. The connector has a circumferential projection here. A latching means engages behind the projection and keeps it on the receptacle.

A disadvantage with the known connection is that movements of the the supply line which is connected to the connector and is generally of flexible configuration can lead to leaks in the connection. The invention is therefore based on the problem of configuring a connection of the type mentioned at the beginning in such a way that it has a particularly reliable seal.

This problem is solved according to the invention by virtue of the fact that the connector can be locked fixed in terms of rotation in various angular positions in the receptacle.

As a result of this configuration, the connector is reliably connected to the receptacle. Movements of the supply line which is connected to the connector are therefore supported thanks to the invention and can therefore no longer lead to leaks after the connector has been mounted in the receptacle. The connection according to the invention therefore has a particularly reliable and durable seal during the service life of the feed pump.

According to one advantageous development of the invention, the locking fixed in terms of rotation of the connector is structurally particularly simple if the connector has a polygon which can be connected in a positively locking fashion to the receptacle.

According to another advantageous development of the invention, supplying a sucking jet pump, provided for feeding fuel within the fuel reservoir, with fuel as the working fluid requires a particularly low level of constructional expenditure if the connector has two outlets. The second outlet can be used, for example, to drive a sucking jet pump for feeding fuel within the fuel reservoir.

The connection according to the invention requires a particularly small number of components to be mounted if a housing lid, comprising the receptacle, of the feed pump has a latching hook for securing the connector.

According to another advantageous development of the invention, the connector can be mounted in the receptacle and removed particularly easily if a latching means is detachably connected to the receptacle and to the connector. This configuration also permits a simple connection of a test adapter to the feed pump before the supply line is mounted.

According to another advantageous development of the invention, the connector is of particularly simple construction if a pin, penetrating the receptacle, of the connector has a latching recess and if the latching hook or the latching means penetrates the latching recess. However, it is also conceivable to arrange latching hooks or latching means in the connector, which themselves penetrate latching recesses located on the feed pump. These latching recesses may be formed either as a circumferential groove or as individual recesses. The use of individual recesses has the advantage over a circumferential groove that the parts which are to be connected are simultaneously locked fixed in terms of rotation with respect to one another.

According to another advantageous development of the invention, subjecting the latching means to bending strain can easily be avoided if the receptacle has a latching recess in its region which surrounds the pin and if the latching means penetrates the receptacle in the region of the latching recess and penetrates the latching recess of the pin.

Mounting of the connection according to the invention is particularly simple if the latching means is shaped in the form of a clip.

According to another advantageous development of the invention, tilting of the connector with respect to the receptacle can be easily avoided if the receptacle has two latching recesses which are arranged opposite one another.

The connection according to the invention can be fabricated particularly cost-effectively if the latching means is fabricated from plastic using an injection molding method.

The invention permits numerous embodiments. In order to clarify its basic principle further, two of said embodiments are illustrated in the drawing and will be explained below. In said drawing.

Figure 1:
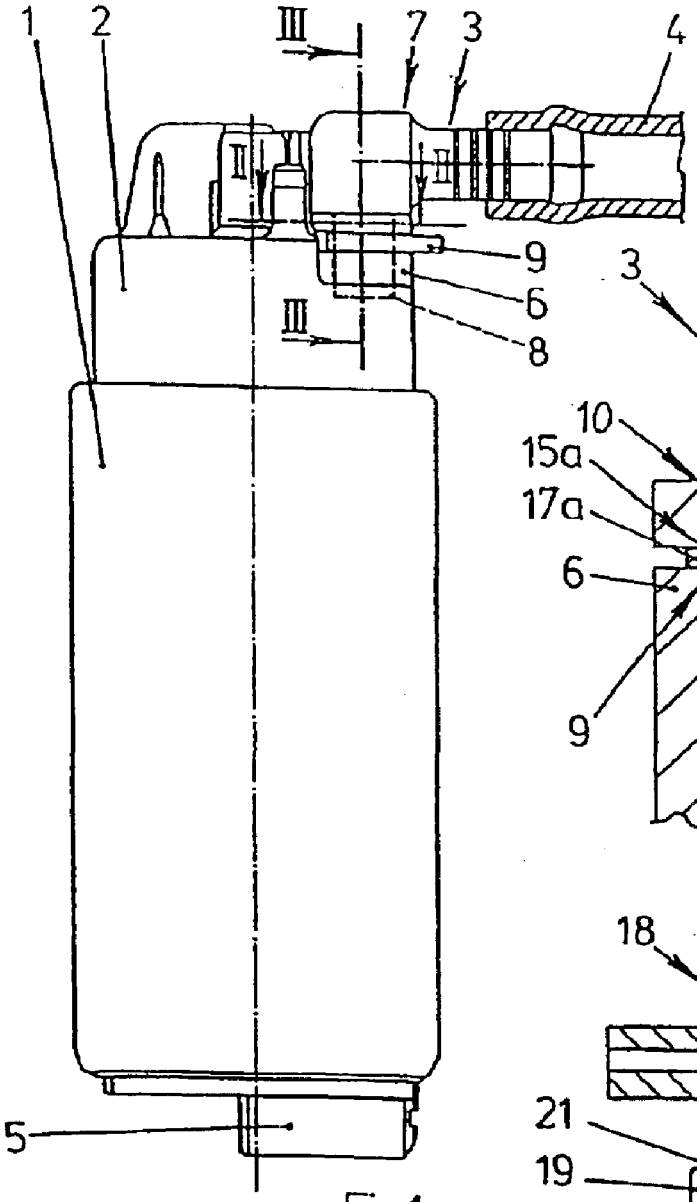
FIG. 1 shows a feed pump having a connection according to the invention.

FIG. 1 shows a feed pump of a motor vehicle having a housing 1 and having a housing lid 2. The housing lid 2 is fitted with a connection 3 with a supply line 4 connected thereto. The supply line 4 is illustrated in section in the drawing and leads, for example, to a flange (not illustrated) of a fuel reservoir of the motor vehicle. The feed pump sucks in fuel via an intake tube 5 arranged opposite the housing lid 2 and feeds said fuel to the connection 3. The connection 3 has a connector 7 which is attached in the receptacle 6 arranged in the housing lid 2. The connector 7 is of angular shape and projects with a pin 8 into the receptacle 6. In the region of the pin 8, the connector 7 is connected in a positively locking fashion to the receptacle 6 by means of a detachable latching means 9.

Figure 2:
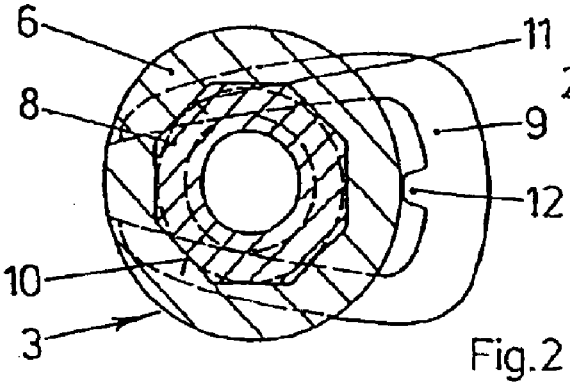
FIG. 2 shows an enlarged sectional view through the connection from FIG. 1 along the line II—II.

FIG. 2 shows the connection 3 from FIG. 1 in an enlarged longitudinal section along the line II—II. The pin 8 has a polygon 10, with which it is inserted into the correspondingly shaped receptacle 6. The pin 8 and thus the connector 7 illustrated in FIG. 1 can by this means be locked fixed in terms of rotation in various angular positions with respect to the receptacle 6. The receptacle 6 has a polygonal socket 11 here with the same shape as the polygon 10 of the pin 8. Of course, the receptacle 6 can also have fine embossing with which it engages laterally around the edges of the polygon 10 of the pin 8. The latching means 9 is supported with a projection 12 on the outside of the receptacle 6.

Figure 3:
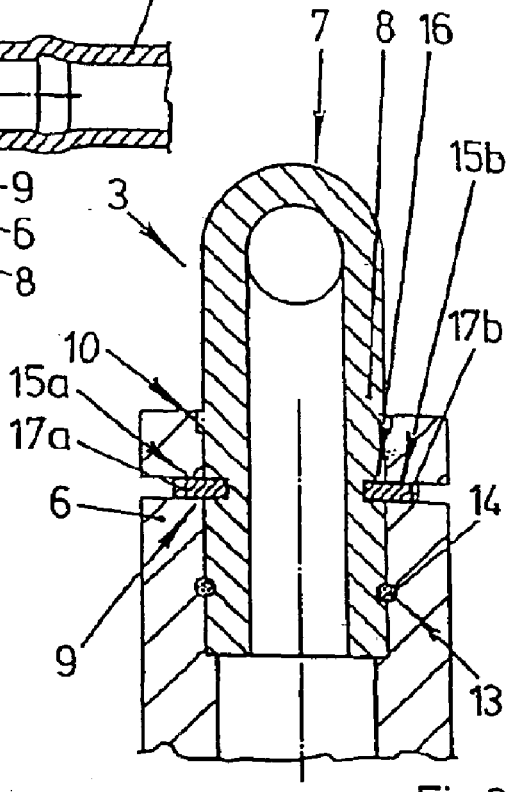
FIG. 3 shows an enlarged longitudinal section through the connection from FIG. 1 along the line III—III.

FIG. 3 shows through the connection 3 from FIG. 1 in an enlarged sectional view along the line III—III. The pin 8 of the connector 7 has a groove 13 for receiving an O-ring 14. The O-ring 14 is prestressed against the wall of the receptacle 6 and seals the pin 8. In addition, FIG. 3 shows that the receptacle 6 has two latching recesses 15*a,* 15*b* opposite one another. The pin 8 has a latching recess 16 which is embodied as a circumferential groove. The latching means 9 has latching arms 17*a,* 17*b* which engage in the latching recesses 15*a,* 15*b,* 16.

Figure 4:
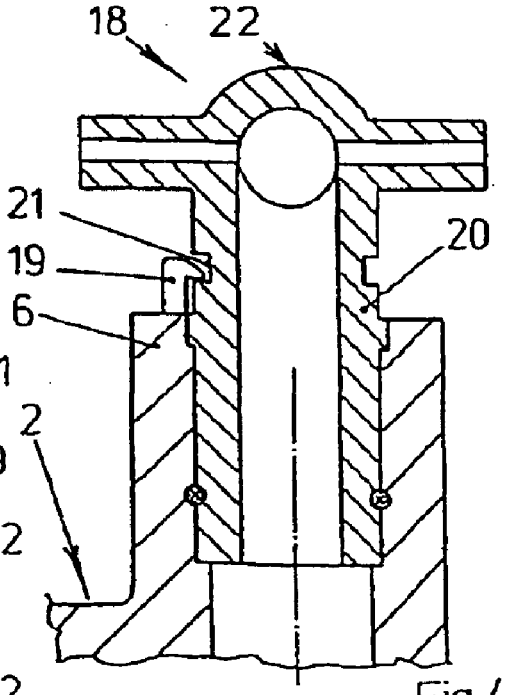
FIG. 4 shows a longitudinal section through a further embodiment of the connection according to the invention.

FIG. 4 shows a connection 18 in a longitudinal section. This connection 18 differs from that in FIG. 3 in particular in that a latching hook 19 is arranged on the housing lid 2 in the region of the receptacle 6. A pin 20 of the connector 22 has a latching recess 21 which is embodied as a circumferential groove. In the illustrated mounted state of the connection 18, the latching hook 19 penetrates the latching recess 21 and holds the connector 21 in position. In addition, the connector 21 has two outlets 23, 24, one of which is used for connecting the supply line 4 illustrated in FIG. 1. For example, a sucking jet pump (not illustrated) which is provided for feeding fuel within the fuel reservoir can be connected to the other outlet 23, 24.

What is claimed is:

1. A connection for a supply line, leading to an internal combustion engine of a motor vehicle, on a feed pump which feeds fuel from a fuel reservoir, comprising:

a receptacle which is connected to the feed pump; and a connector which is configured to be connected in a positively locking fashion to the receptacle and has a bend, wherein the connector is locked fixed in terms of rotation in different angular positions in the receptacle, and the connector has a polygon configured section to be connected in a positively locking fashion with the receptacle to prevent rotation, the section aligned with a longitudinal axis of the connector.

2. The connection as claimed in claim 1, wherein the connector has two outlets.

3. The connection as claimed in claim 1, further comprising a housing lid, including the receptacle, of the feed pump has a latching hook for securing the connector.

4. The connection as claimed claim 3, further comprising a latching device detachably connected to the receptacle and to the connector.

5. The connection as claimed in claim 4, wherein the latching device is shaped in the form of a clip.

6. The connection as claimed in claim 4, wherein the latching device is fabricated from plastic using an injection molding method.

7. The connection as claimed claim 4, further comprising a pin, penetrating the receptacle, of the connector which has a latching recess, and the latching hook or the latching device penetrates the latching recess.

8. The connection as claimed in claim 7, the receptacle has a latching recess in a region which surrounds the pin, and the latching device penetrates the receptacle in the region of the latching recess and penetrates the latching recess of the pin.

9. The connection as claimed in claim 7, wherein the receptacle has two latching recesses and penetrates the latching recess of the pin.

* * * * *